United States Patent [19]

Kanervo

[11] 4,213,361

[45] Jul. 22, 1980

[54] PERFORATION METHOD

[75] Inventor: Seppo Kanervo, Espoo, Finland

[73] Assignee: Oy Wartsila AB, Helsinki, Finland

[21] Appl. No.: 886,570

[22] Filed: Mar. 15, 1978

[30] Foreign Application Priority Data

Mar. 18, 1977 [FI] Finland ..... 770856

[51] Int. Cl.[2] ..... B26F 1/24; B26F 1/20

[52] U.S. Cl. ..... 83/30; 83/405

[58] Field of Search ..... 83/30, 300, 303, 405, 83/687

[56] References Cited

U.S. PATENT DOCUMENTS 3,255,651 6/1966 Huck ..... 83/405 X 3,866,497 2/1975 Wolfberg et al. ..... 83/30

*Primary Examiner*—Donald R. Schran

*Attorney, Agent, or Firm*—J. Harold Nissen

[57] ABSTRACT

A method for providing a running web with a perforation pattern fitting into printed image units successively printed on the web. The method includes the steps of performing a longitudinal perforation in a separate longitudinal perforator and performing a transverse perforation in a transverse perforator, wherein the perforation is divided to be carried out by a plurality of separate units. The pitch of the transverse perforation rows in the longitudinal direction of the web is controlled by changing the relative position of the transverse perforation units with respect to each other in accordance with the desired perforation pattern. The transverse perforator can be formed by a plurality of transverse perforation units each having a die roll in cooperation with two needle rolls placed diametrically at opposite sides of the die roll.

9 Claims, 2 Drawing Figures

PERFORATION METHOD

Figure 1:
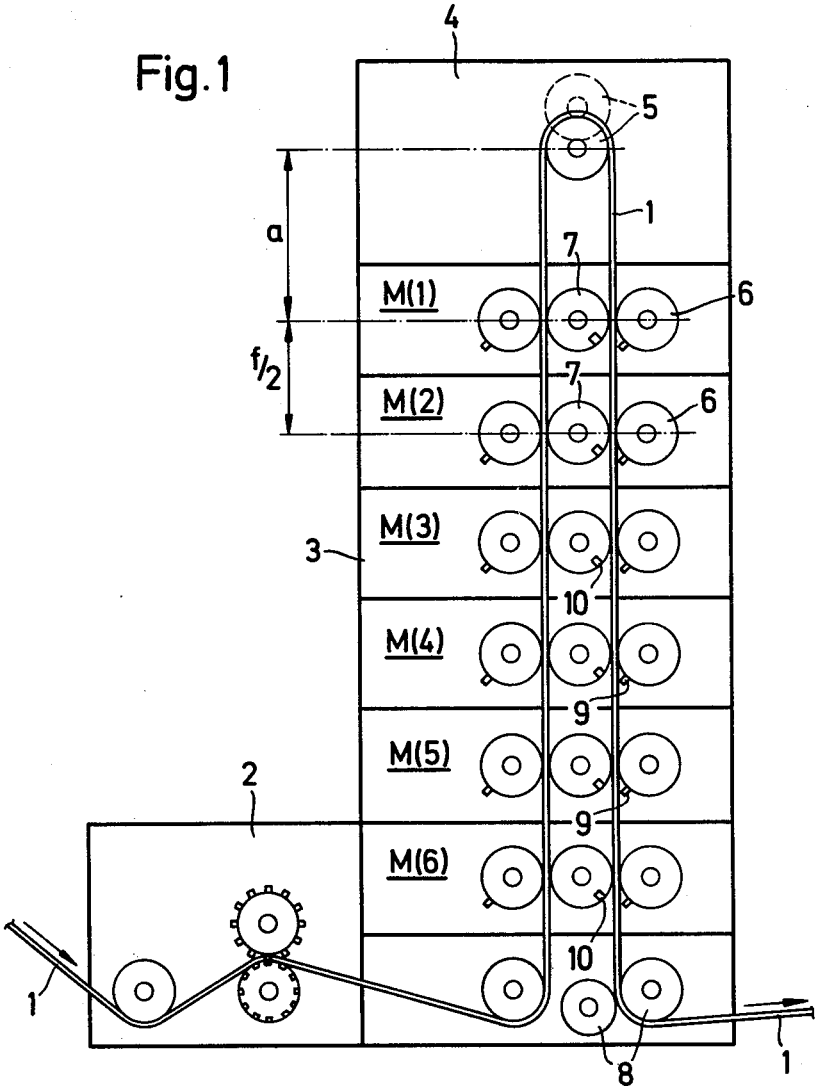

The invention relates to a method for providing printed image elements, for instance, stamps or similar marks, with an edge perforation in printed image units successively printed on a web.

In this specification and in the claims the concept "printed image unit" means a large entity, for instance a stamp sheet suitable as a repeatedly printed image and being formed by small printed image elements, such as stamps, tax marks, or the like. The length of a printed image unit refers to the longitudinal distance between any mutually corresponding points on two successive image units printed on a web. A single needle or the like of the needle roll of a perforator is a called a perforating tool element, whereas a perforating tool is bigger entity, for example, a row of said perforating tool elements.

According to conventional methods, the perforation referred to above is carried out by using one needle roll/die roll-pair so that each perforating tool element is fixed to the needle roll in accordance with the actual size of the printed image elements to be perforated. The perforation itself is carried out either by separately punching each transverse row of perforation holes, which is rather time consuming, or by means of a continuous rotation in more modern devices. A considerable drawback of known perforation methods is therein that when the size of the printed image elements is changed, the setting of the perforating tool elements in the needle rolls has to be rearranged correspondingly. This is a rather troublesome and, hence, also slow work causing additional costs and unnecessarily long interruptions of the perforation work.

An object of the invention is to improve the perforation of printed image elements by eliminating the drawbacks described above. The invention is characterized in that a longitudinal perforation is performed in a separate longitudinal perforator and a transverse perforation is performed in a transverse perforator, wherein the perforation is divided to be carried out by separate rolls and wherein the pitch of the transverse perforation rows is controlled by changing the relative position of said rolls with respect to each other in accordance with the desired size of the printed image elements. In this way the dividing of the perforation performance to separate rolls and the adjustability of the transverse perforator rolls relatively to each other makes it possible to change from one element size to another with much more flexibility and less effort than before.

The needle rolls of the transverse perforator can suitably be provided with a replaceable needle comb or a similar perforating tool. In order to simplify the adjustment of the rolls, each needle roll is arranged to provide only one transverse row of perforation holes. Thereby, the pitch of the transverse perforation rows can easily be varied by changing the phase angle of the rolls as well as the number of operative needle rolls in the transverse perforator. The latter is carried out, for example, by providing the needle roll with a needle comb only when so required. Thus, if a smaller number of transverse perforation rows is needed because of larger printed image elements being present, unnecessary needle combs are removed and the relative phase angle of the remaining rolls which still have needle combs is changed. Correspondingly, when the element size is to be smaller a suitably increased number of needle rolls is made operative. Also other kinds of roll adjustments may be applicable, for example, changing of the distance between the rolls. In practice, however, such adjustments have proved to be much more complicated to carry out.

An advantageous design, i.a. with respect to the space needed is obtained if the transverse perforator is formed by a plurality of transverse perforation units each having a die roll in cooperation with two needle rolls arranged diametrically at opposite sides of the die roll. It is then of advantage to provide the printed web with transverse perforation rows by one of the needle roll/-die roll-pairs of each transverse perforation unit, whereafter the web is made to form a loop of adjustable size so that the transverse perforation rows made by the second needle roll/die roll-pair of the transverse perforation units will be exactly located to their proper place. The adjustment of said loop can be carried out, for example, with a movable roll. By the arrangement described the number of die rolls needed can be reduced to half the number.

By synchronizing the rotation of the rolls of a transverse perforation unit relatively to each other a precise cooperation between the needle roll and the die roll is secured. Then the phase angle of all the rolls of a unit can easily be changed, for example, by adjusting the phase angle of the central die roll, whereby a smaller number of adjusting devices is needed. The adjusting operation can be eased up by providing the phase angle adjustment means of the rolls with an adjustment scale with preset adjustment steps corresponding to certain printed image element sizes. By changing the needle combs and the die bars of the die rolls perforation scales having completely different adjustment steps can be used. By continuous perforation of a web with printed image units the theoretical circumference of the transverse perforator rolls equals the length of the printed image unit which is to be perforated, and the distance between the transverse perforation units as measured between the actual points of perforation is half the length of the printed image unit to be perforated. The latter distance could as well be an integer multiple of said basic measure, but this would result in an unnecessarily extended perforator. In this context the theoretical circumference of the rolls means the radius of the rolls at the perforation points multiplied by $2\pi$.

Considering the perforation result and the quality of the printed image elements, it is recommended that the longitudinal perforation be synchronized with the transverse perforation and that the perforation holes being part of the longitudinal as well as the transverse perforation rows be made either in the longitudinal perforating phase or in the transverse perforation phase. In the latter case, the intention is to eliminate the possible anomalies and irregularities due to double perforation.

The invention also relates to a perforation arrangement including a separate longitudinal perforator and a separate transverse perforator and arranged for applying the method described above and any feature thereof.

The invention is illustrated in the attached drawing, in which

Figure 2:
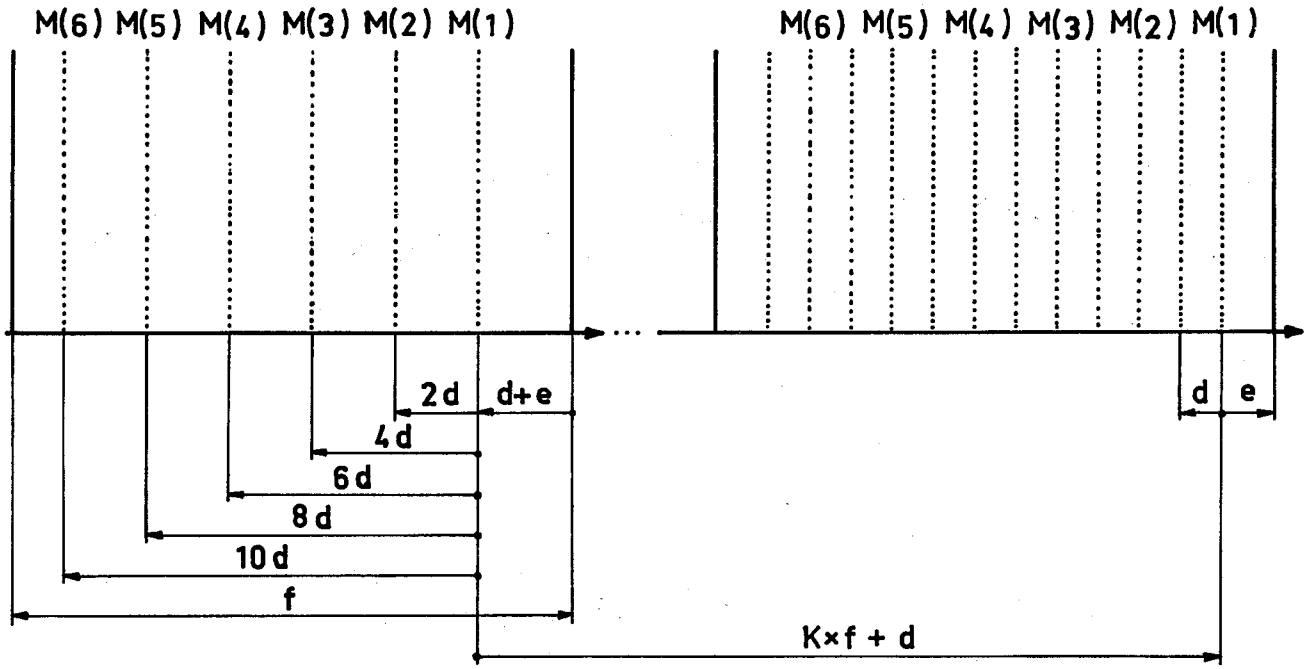

FIG. 1 shows a schematic view of a preferred embodiment of a perforation arrangement according to the invention and FIG. 2 shows schematically the operation principle of the transverse perforator of the arrangement according to FIG. 1.

In the drawing, the numeral 1 indicates a web with printed image units which is to be perforated and which, according to the shown embodiment, is first perforated longitudinally in a longitudinal perforator 2 provided with perforating tools arranged in accordance with the size of the printed image elements and performing a longitudinal perforation of one printed image unit in one full rotation. Then the transverse perforation is carried out in a transverse perforator comprising transverse perforation units 3 and further including an adjustment device 4 with an adjustment roll 5 for the internal longitudinal adjustment of the transverse perforation, and a web advancement unit 8. Each transverse perforation unit 3 comprises a die roll 7 and two needle rolls 6 synchronized to each other. The adjustment of the phase angle of the rolls of each unit 3 is carried out by adjusting the die roll 7, whereby the phase angle of the needle rolls automatically is changed accordingly. The adjustment means, which are not shown in the drawing, can be provided with an adjustment scale with preset adjustment steps corresponding to certain printed image element sizes, whereby, for example, when perforating stamps a philatelistic scale is used. The adjustment scale can be changed. If, at the same time, there is also a change of the die bars 10 or the like of the die rolls as well as of the needle combs 9 of the needle rolls, the detailed design of which is not shown in the drawing, new printed image element sizes as well as even totally new perforation standards can be used.

For a better understanding of the invention, the transverse perforation units 3 are called M(1) . . . M(6). The number of transverse perforation units can be varied, when so required, according to the desired maximal number of transverse perforation rows of one printed image unit. When the number of transverse perforation rows of one printed image unit is to be changed, the number of operative needle rolls is changed either by disconnecting unnecessary perforation roll pairs from operation in the transverse perforator, or by connecting additional perforation roll pairs into operation, whereafter the rolls are adjusted to new phase angles according to the preset adjustment scale. The construction shown in FIG. 1 also requires an internal longitudinal adjustment of the transverse perforation carried out by means of the adjustment device 4, whereby the distance between the adjustment roll 5 and the unit M(1) is set so that the second transverse perforation row made by the unit M(1) is properly located. Also this adjustment can be performed by making use of a preset adjustment scale.

The adjustment technique used requires that the theoretical circumference of the rolls of the transverse perforator shown in the drawing as well as the distance between the separate units 3 are, in a way described before, dependent on the length of the printed image units which is to be perforated, for example a sheet.

According to the operational principle shown in FIG. 2, each transverse perforator 3 perforates a first transverse perforation row whereafter a second transverse perforation row is perforated when the web again passes through the perforation units 3. In FIG. 2, each transverse perforation row has been marked in accordance with the unit 3 which has perforated the transverse perforation row in question.

When determining f = the length of a printed image unit to be perforated and consequently, also the circumference of rolls 6 and 7 as described above d = the length of a printed image element and also the distance between two successive transverse perforation rows a = the distance between the adjustment roll 5 and the transverse perforation unit M(1), the phase angle of each transverse perforation unit M(N) as illustrated in FIG. 2, can be obtained from the equation:

$$Q(N) = -(N-1)\,(f/2-2d), \text{ wherein } N\epsilon\{1,2,3,4,5,6\}.$$

Thus, the adjustment has started from the unit M(1) for which Q(1)=0. The phase angle Q(N) of each unit M(N) is equal to the phase angle of the respective die roll.

When the diameter of the adjustment roll 5 is equal to the diameter of the needle rolls 6 and of the die rolls 7 and when taking into account that the operative phase difference between the needle rolls 6 and the unit M(1) is f/2, the internal longitudinal adjustment of the transverse perforation equals $$a = (Kf+d)/2, \text{ wherein } K\epsilon\{1,2,3\ldots\}$$

If the die roll of a transverse perforation unit is provided with a separate die bar for both the needle rolls of the unit, the expression given above has to be supplemented with a constant, the value and the sign of which depend on the distance between and the location of the die bars of the die rolls. In order to simplify the longitudinal adjustment of the transverse perforation the die bars are arranged in the same way in all the die rolls.

The web with the printed image units can be provided with margins e (FIG. 2) between successive printed image units, but depending on the setting of the rolls a web without margins can be perforated as well.

The invention is not restricted to the embodiment shown but several modifications thereof are feasible within the scope of the attached claims.

I claim:

1. A method for providing a running web with a perforation pattern fitting into printed image units successively printed on the web, the method including the steps of:

longitudinally perforating the web in a separate longitudinal perforator as the web is moved therethrough; and, transversely perforating the web in a transverse perforator to provide a plurality of transverse perforation rows comprising:

passing the web through a plurality of separate perforation units, one for each of the transverse perforation rows, and controlling the pitch of the transverse perforation rows in the longitudinal direction of the web by changing the relative position of the units with respect to each other in accordance with the desired perforation pattern.

2. The method as claimed in claim 1, wherein each transverse perforation unit includes a perforating needle roll, and including the step of arranging the needle roll to provide only one transverse perforation roll.

3. A method as claimed in claim 2, wherein the step of controlling the pitch of the transverse perforation rows in the longitudinal direction of said web comprises changing the angular position of the rolls as well as the number of operative needle rolls in the transverse perforator.

4. A method as claimed in claim 3, wherein each of said plurality of separate perforation units includes a die roll and two needle rolls placed diametrically at opposite sides of the die roll in cooperation therewith, and including the steps of first leading the web a first time in the transverse perforator in a first run through a plurality of the operative perforation units in contact with the needle rolls on one side of the die rolls, each of which provides the web with one transverse perforation row by means of the one of the needle rolls in each of said units, forming a loop of adjustable length in the web, and passing the web a second time through the transverse perforator in a second run in contact with the second needle roll in each of the units to provide the web with another transverse perforation row properly located with respect to the set of perforation rows made in the first run through the transverse perforator.

5. A method as claimed in claim 4, including the steps of synchronizing the rotation of the rolls of the transverse perforation units relative to each other, and changing the angular position of all the rolls of the transverse perforation units by adjusting the angular position of one roll only.

6. A method as claimed in claim 5, including the step of angularly adjusting each transverse perforation unit with an angle adjustment and presetting a scale during the angular adjustment of the transverse perforation unit to produce preset adjustment steps corresponding to a certain perforation pattern.

7. A method as claimed in claim 1, including the step of using, in the transverse perforator, rolls having a theoretical circumference which equals the length of the printed image unit which is to be perforated.

8. A method as claimed in claim 1, including the step of adjusting the distance between the transverse perforation units measured between the actual points of perforation to be an integer multiple, including multiplication by 1, of half the length of the printed image unit to be perforated.

9. A method as claimed in claim 8, including the steps of synchronizing the longitudinal perforation with the transverse perforation and arranging such perforation holes which are part of a longitudinal as well as of a transverse perforation row to be made by one perforating element only.

* * * * *